United States Patent [19]

Nierga

[11] Patent Number: 4,505,247

[45] Date of Patent: Mar. 19, 1985

[54] SYSTEMS FOR VARYING THE ADVANCE OF AN INJECTION PUMP, PARTICULARLY OF THE DISTRIBUTOR TYPE

[75] Inventor: Manuel R. Nierga, Barcelona, Spain

[73] Assignee: Spica S.p.A., Livorno, Italy

[21] Appl. No.: 480,323

[22] Filed: Mar. 30, 1983

[30] Foreign Application Priority Data

Apr. 3, 1982 [DE] Fed. Rep. of Germany ..... 3212524

[51] Int. Cl.[3] ..... F02M 59/20

[52] U.S. Cl. ..... 123/500; 123/449; 123/495

[58] Field of Search ..... 123/500, 501, 449, 502, 123/495, 450; 417/440, 441, 456, 505

[56] References Cited

U.S. PATENT DOCUMENTS

| | | | |
|---|---|---|---|
| 3,358,662 | 12/1967 | Kulke | 123/449 |
| 3,815,564 | 6/1974 | Suda | 123/502 |
| 4,073,277 | 2/1978 | Eheim | 123/501 |
| 4,079,719 | 3/1978 | Varcoe | 123/502 |

*Primary Examiner*—Charles J. Myhre
*Assistant Examiner*—Carl Stuart Miller
*Attorney, Agent, or Firm*—Diller, Ramik & Wight

[57] ABSTRACT

A timing advance variator for a fuel injection pump, the reciprocal movement of which is obtained by means of a transverse arm fixed to the drive shaft acting on the piston and in contact, by means of rollers, with a cam ring disposed in the pump casing, characterized by the fact that the cam ring is connected by a worm helical gear device the pin of which is constrained axially to the injection pump casing, which pin can be rotated by driving means for the movement of the cam ring.

18 Claims, 3 Drawing Figures

SYSTEMS FOR VARYING THE ADVANCE OF AN INJECTION PUMP, PARTICULARLY OF THE DISTRIBUTOR TYPE

With increasing engine rotational speeds, it has become increasingly necessary to provide fuel injection pumps with a device able to vary the timing of the commencement of injection in accordance with engine operating conditions.

These advance variators, initially manual, were converted into automatic and satisfied simple timing variation relationships between the pump and engine which were a function only of the speed of rotation of the assembly.

With the introduction and subsequent tightening of the regulations regarding the limitation of exhaust emissions and smoke, the requirements relative to varying the advance over the entire operational range of the engine required the satisfying of complicated relationships and the analysis of various operational parameters. The definition of optimum timing must therefore take account not only of speed but of other parameters such as the engine loading conditions, its temperature, special starting requirements etc.

In injection pumps of the distributor type, these greater requirements have been partly satisfied by adding, to the original hydraulic variator which determines the relative position of the roller ring to the control cam, various devices for correcting the timing in accordance with the engine operating conditions. In spite of the complexity of the methods used, this technique does not, however, allow the widest degree of freedom in choosing the timing variation relationships which can be satisfied.

In order to obviate these limitations, various electronically controlled timing variator versions with a central control unit have been presented in recent years. This system enables the pattern of optimum timing for any functional application to be defined at the electronic control unit.

In one known embodiment (BOSCH-D 29 23 445), the advance control element consists of a solenoid valve which either feeds or discharges the cylinder of a hydraulic actuator in order to modify the position of the roller shaft and thus the injection timing, in accordance with the instructions received from an electronic control unit.

In another embodiment (BOSH-FR 2,030,975), the electronic command acts on the preloading of the spring of a reflow valve in order to vary the operating pressure of the hydraulic cylinder, and thus obtain timing variation in accordance with the engine loading.

Other known embodiments comprise the use of complicated hydraulic servo-actuator systems controlled by electric motors (CAV-GB 1 441 262) or by linear variable force electromagnets (BOSCH-GB 2 031 187 A), to determine the position of the piston connected to the cam element.

As can be seen, the element common to all the aforesaid known methods is the final hydraulic device for physically defining the position of the cam or roller element which determines the injection timing. With such hydraulic devices there is, however, the problem of withstanding the reaction torque present on the cam or roller ring during pumping, without allowing the hydraulic piston to make any appreciable movement. For this purpose, some systems comprise a non-return valve and a sized throttling orifice connected in parallel with the hydraulic actuator feed circuit. In the case of rapid need to increase the advance, the unidirectional valve acts immediately on the hydraulic variation device by closing the connection during the cylinder pressure increase due to the reaction torque during the injection stage. In contrast, the throttling orifice enables the liquid contained in the cylinder to be discharged in order to reduce the injection advance. The sizing of this sized orifice is, however, a compromise between the need to prevent the undesirale beating of the piston and the requirement to not eccessively delay the variation in the advance should it become necessary to reduce it.

Because of this compromise and the slight delay in closing the liquid feed conduit determined by the inertia of the non-return valve, the oscillation of the piston due to the imperfect absorption of the reaction torque continues to be present, although only to a small extent. This damaging vibration is also present in the entire equipment controlling the reciprocating motion of the pumping element of the injection pump.

In the aforesaid patents D 29 23 445 and FR 2 030 975, the presence of the non-return valve and sized orifice can be noted.

However, in the known embodiments of the aforesaid patents GB 1 441 262 and GB 2 031 187 A, hydraulic servo-actuators are used, as stated, for defining the timing position of the cam or roller ring. However, in spite of their complexity, even these devices are not insensitive to the reaction torque of the fuel pumping action. In this respect, ignoring the fluid compressibility, the elasticity of the conduits and the degree of sealing of the servo-actuator casing, it can be seen that during the advance variation transients, the operating cylinder chamber is connected directly to the liquid or discharge circuit. The excess pressure determined by the thrust resulting from the reaction torque on the cam ring can lead, particularly during the advance increase transient, to an uncontrolled beating action and a possible although limited reversal of movement of the operating piston.

It should also be noted that for operating purposes the hydraulic servo-actuator devices require a source of pressurised liquid, and an auxiliary electric pump must therefore be available for feeding the operating fluid when the engine is at rest, in order to determine the optimum advance conditions necessary for starting the engine.

The object of the present invention is to obviate the aforesaid defects by providing a simple and convenient device for varying the advance of an injection pump, particularly of the distributor type, which can be operated electronically even when the engine is at rest, and in which the components of the reaction torque deriving from the pumping action do not cause pulsation of the mobile variation element, and are not transmitted to the electrical control means.

For this purpose, the invention uses a worm actuator element, together with conjugated helical toothing on the periphery of a sector of the cam or rolling ring. The rotation of the worm, which is axially constrained to the injection pump casing, therefore determines a proportional rotation of the cam ring and a corresponding variation in the injection timing. The worm is driven directly by an electric motor of the servo-controlled or stepping type, and can thus be easily driven even when the engine is at rest in order to seek the optimum injection timing for the subsequent start, in accordance with the engine thermal conditions.

The thrust resulting from the reaction torque on the cam ring is discharged on to the worm shaft, and therefore does not affect the worm drive means. These means can consequently be of low force, dimensions and cost, as the required rotation of the worm is effected during periods of low or zero axial reaction of the cam ring, whereas it is locked during the injection pump delivery stage.

The described system can be completed by means for stopping the rotation of the cam ring in the maximum advance position. Said means are of adjustable type operable from the outside.

A further advantage of the system is that it offers widest freedom in the choice of the positioning of the worm-electric drive motor unit. This unit can in fact be positioned above, under or to the side of the injection pump, and assume varius angles to the plane passing through one of the faces of the cam or roller ring, according to space availability.

The structural and operational characteristics of the invention and its advantages over the known art will be more apparent from an examination of the description given hereinafter by way of example with reference to the accompanying diagrammatic drawings in which.

Figure 1:
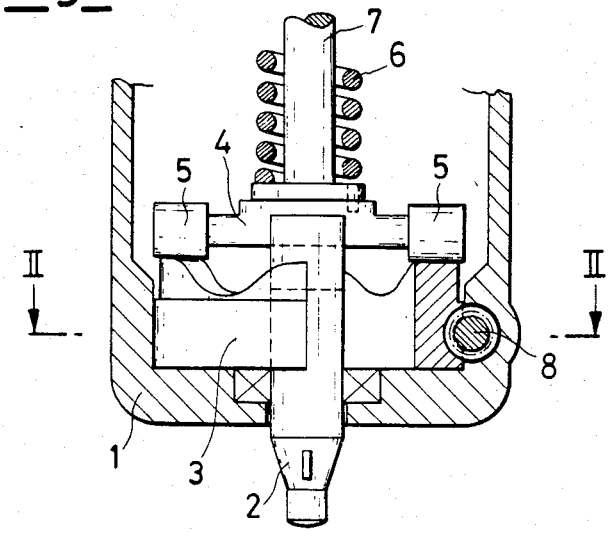
FIG. 1 is a section through an advance variator for an injection pump of the distributor type, in accordance with the invention.

With reference to FIG. 1, the casing 1, shown in diagrammatic elementary form, of an injection pump of the distributor type contains a drive shaft 2, a cam disc 3 and a transverse arm 4 fitted with rollers 5, the arm being driven by the shaft 2 and pressed against the cams by the reaction spring 6 to transmit to the piston 7 a reciprocating movement for pumping the fuel, and a rotary movement for distributing this latter to the various engine cylinders.

Figure 2:
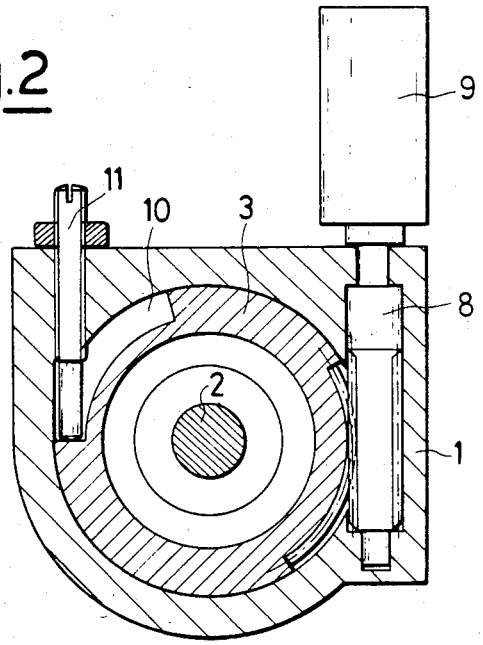
FIG. 2 is a section on the line II—II of FIG. 1.

A peripheral portion of the cam ring (FIG. 2) comprises helical toothing conjugate with the transverse worm pin 8, which is driven with reciprocating rotation by the electric drive motor 9.

Due to the fact that, as stated, the transverse pin 8 is axially constrained to the casing 1, each revolution of said pin produces a variation in the angular position of the cam disc 3 relative to said casing, and a consequent variation in the timing of the pump injection stroke.

Following instructions received from a central electronic control unit (not shown), the electric drive motor 9 effects the angular movement of the cam ring until optimum timing is obtained for any engine operating condition.

The resultant of the reaction torque which originates from the cam ring during pumping delivery is discharged on to the shaft of the worm pin 8, and thus on to the casing connected to it, without affecting the drive motor 9. The rotation of the pin 8 is intermittent, and coincides with the stages during which the axial reaction is zero (rollers at the cam dead centres) or low (intake stage), and is locked during the pumping stage.

In those cases in which the value of the reaction torque is found to be such as to require a larger contact surface between the operating worm and the cam ring, the worm can be of known globoidal shape.

A groove 10 cooperating with the adjustment screw 11 can be provided on the periphery of the cam ring in order to define a limitstop corresponding to the maximum advance of the injection pump.

Figure 3:
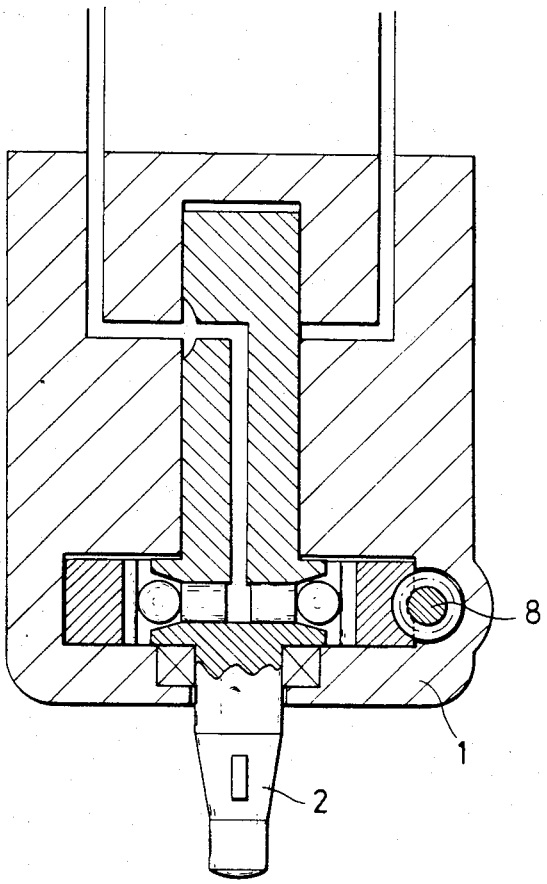
FIG. 3 is a section through a different distributor-type pump with the variation device according to the present invention fitted.

The timing variation device as heretofore described is obviously applicable to any type of injection pump, without leaving the scope of the invention. By way of example, FIG. 3 shows the variation device connected to the cam disc of a known radial piston distributor-type pump.

The same consideration applies if the elements cooperating in the reciprocating movement of the pumping member are reversed, i.e. using a fixed roller disc and a rotation cam element.

I claim:

1. A fuel injection pump comprising a casing, a pump unit including a piston adapted for reciprocal and rotary motion relative to said casing, cooperative cam means and cam follower means within said casing for controlling the reciprocal motion of said piston, one of said cam means and cam follower means being carried by said piston and the other of said cam means and cam follower means being carried by said casing, said cam means and cam follower means being in engagement with each other drive means for imparting generally continuous rotary motion to said piston and to one of said cam means and cam follower means along a generally circumferential path to thereby generally continuously rotate said piston and said one cam means and cam follower means, the other of said cam means and cam follower means being disposed along said circumferential path, means for selectively intermittently circumferentially adjusting the position of said other of said cam means and cam follower means relative to said casing and circumferentially about the axis of rotation of said piston, said selective circumferential adjusting means including worm means carried by said casing for meshing with and imparting selective opposite rotation to thread means of the other of said cam and cam follower means upon rotation of said worm means, said worm means and thread means being further operative for preventing movement of the other of said cam means and cam follower means relative to said casing in any position of relative selective circumferential adjustment when said worm means is stationary, means for imparting selective rotary movement to said worm means which through said thread means is effective to directly circumferentially adjust the other of said cam means and cam follower means along said circumferential path and thereby vary the operation of said piston, and means for rotatably supporting said worm within bore means of said casing.

2. The fuel injection pump as defined in claim 1 wherein said cam means includes a plurality of cam lobes, and said cam follower means are rotated by said drive means.

3. The fuel injection pump as defined in claim 1 wherein said thread means is helical toothing provided directly upon a circumferential portion of said cam means.

4. The fuel injection pump as defined in claim 1 including means for preventing movement of said worm means relative to its axis and to said casing thereby preventing the aforesaid movement when said worm is stationery.

5. The fuel injection pump as defined in claim 1 wherein said worm means rotating movement imparting means is an electric motor.

6. The fuel injection pump as defined in claim 1 including means for operating said worm means rotary movement imparting means in response to an indication of generally insignificant axial reaction forces upon said worm means.

7. The fuel injection pump as defined in claim 1 including means for limiting at least in one circumferential direction the circumferential adjustment of the other of said cam means and cam follower means.

8. A fuel injection pump comprising a casing, a pump unit including a piston adapted for reciprocal and rotary motion relative to said casing, cooperative cam means and cam follower means within said casing for controlling the reciprocal motion of said piston, one of said cam means and cam follower means being carried by said piston and the other of said cam means and cam follower means being carried by said casing, said cam means and cam follower means being in engagement with each other, drive means for imparting rotary motion to said piston to thereby rotate said one of said cam means and cam follower means along a generally circumferential path, the other of said cam means and cam follower means being disposed along said circumferential path, means for selectively circumferentially adjusting the position of said other of said cam means and cam follower means relative to said casing, said selective circumferential adjusting means including worm means carried by said casing for meshing with and imparting selective opposite rotation to thread means of the other of said cam and cam follower means upon rotation of said worm means, said worm means and thread means being further operative for preventing movement of the other of said cam means and cam follower means relative to said casing in any position of relative selective circumferential adjustment when said worm means is stationary, means for imparting selective rotary movement to said worm means which through said thread means is effective to directly circumferentially adjust the other of said cam means and cam follower means along said circumferential path and thereby vary the operation of said piston, means for limiting at least in one circumferential direction the circumferential adjustment of the other of said cam means and cam follower means, said limiting means including a circumferential groove in a periphery of the other of said cam means and cam follower means, and an adjustment screw carried by said casing with a portion thereof disposed in said circumferential groove.

9. The fuel injection pump as defined in claim 2 wherein said thread means is helical toothing provided directly upon a limited circumferential sector of said cam means.

10. The fuel injection pump as defined in claim 2 including means for preventing movement of said worm means relative to its axis and to said casing thereby preventing the aforesaid movement when said worm is stationary.

11. The fuel injection pump as defined in claim 2 wherein said worm means rotating movement imparting means is an electric motor.

12. The fuel injection pump as defined in claim 4 wherein said worm means rotating movement imparting means is an electric motor.

13. The fuel injection pump as defined in claim 4 including means for operating said worm means rotary movement imparting means in response to an indication of generally insignificant axial reaction forces upon said worm means.

14. The fuel injection pump as defined in claim 4 including means for limiting at least in one circumferential direction the circumferential adjustment of the other of said cam means and cam follower means.

15. A fuel injection pump comprising a casing, a pump unit including a piston adapted for reciprocal and rotary motion relative to said casing, cooperative cam means and cam follower means within said casing for controlling the reciprocal motion of said piston, one of said cam means and cam follower means being carried by said piston and the other of said cam means and cam follower means being carried by said casing, said cam means and cam follower means being in engagement with each other, drive means for imparting rotary motion to said piston to thereby rotate said one of said cam means and cam follower means along a generally circumferential path, the other of said cam means and cam follower means being disposed along said circumferential path, means for selectively circumferentially adjusting the position of said other of said cam means and cam follower means relative to said casing, said selective circumferential adjusting means including worm means carried by said casing for meshing with and imparting selective opposite rotation to thread means of the other of said cam and cam follower means upon rotation of said worm means, said worm means and thread means being further operative for preventing movement of the other of said cam means and cam follower means relative to said casing in any position of relative selective circumferential adjustment when said worm means is stationary, means for imparting selective rotary movement to said worm means which through said thread means is effective to directly circumferentially adjust the other of said cam means and cam follower means along said circumferential path and thereby vary the operation of said piston, means for preventing movement of said worm means relative to its axis and to said casing thereby preventing the aforesaid movement when said worm is stationery, means for limiting at least in one circumferential direction the circumferential adjustment of the other of said cam means and cam follower means, said limiting means including a circumferential groove in a periphery of the other of said cam means and cam follower means, and an adjustment screw carried by said casing with a portion thereof disposed in said circumferential groove.

16. The fuel injection pump as defined in claim 15 wherein said thread means is helical toothing provided directly upon a circumferential portion of said cam means.

17. The fuel injection pump as defined in claim 16 wherein said worm means rotating movement imparting means is an electric motor.

18. The fuel injection pump as defined in claim 16 including means for operating said worm means rotary movement imparting means in response to an indication of generally insignificant axial reaction forces upon said worm means.

* * * * *